US007334591B2

(12) United States Patent
Aloi

(10) Patent No.: US 7,334,591 B2
(45) Date of Patent: Feb. 26, 2008

(54) SLOTTED UMBRELLA STRUCTURE FOR ATTENUATING THE FORCE OF THE WIND WHEN THE UMBRELLA IS OPEN

(75) Inventor: Vincenzo Aloi, Florence (IT)

(73) Assignee: Gardenart S.r.l, Florence (IT)

( * ) Notice: Subject to any disclaimer, the term of this patent is extended or adjusted under 35 U.S.C. 154(b) by 18 days.

(21) Appl. No.: 10/517,676

(22) PCT Filed: Jun. 3, 2003

(86) PCT No.: PCT/IT03/00344

§ 371 (c)(1),
(2), (4) Date: Jul. 18, 2005

(87) PCT Pub. No.: WO03/103437

PCT Pub. Date: Dec. 18, 2003

(65) Prior Publication Data

US 2006/0070645 A1 Apr. 6, 2006

(30) Foreign Application Priority Data

Jun. 7, 2002 (IT) ..... FI2002A0098

(51) Int. Cl.
*A45B 25/00* (2006.01)

(52) U.S. Cl. ..... 135/31; 135/33.2; 135/33.7

(58) Field of Classification Search ..... 135/33.7, 135/33.2, 33.5, 31, 33.4; 411/84, 85
See application file for complete search history.

(56) References Cited

U.S. PATENT DOCUMENTS

| | | | | |
|---|---|---|---|---|
| 3,483,910 | A * | 12/1969 | Van Huffel et al. | 411/112 |
| 3,885,582 | A * | 5/1975 | Kowalski | 135/33.7 |
| 4,146,074 | A * | 3/1979 | Kowalski | 411/111 |
| 5,271,586 | A * | 12/1993 | Schmidt | 248/58 |
| 5,482,069 | A * | 1/1996 | Lee | 135/31 |
| 5,865,201 | A | 2/1999 | Lin | |
| 6,089,244 | A | 7/2000 | Ko | |
| 6,173,724 | B1 | 1/2001 | You | |
| 6,502,592 | B2 * | 1/2003 | Chen | 135/33.7 |
| 6,575,680 | B2 * | 6/2003 | Herb et al. | 411/84 |
| 2003/0198530 | A1 * | 10/2003 | Hoffmann et al. | 411/84 |
| 2004/0165965 | A1 * | 8/2004 | Unverzagt et al. | 411/84 |

FOREIGN PATENT DOCUMENTS

| | | |
|---|---|---|
| DE | 196 27 766 | 9/1997 |
| FR | 1 284 022 | 12/1960 |

* cited by examiner

*Primary Examiner*—David Dunn
*Assistant Examiner*—Noah Chandler Hawk
(74) *Attorney, Agent, or Firm*—McGlew and Tuttle, P.C.

(57) ABSTRACT

The structure of the umbrella comprises improved ribs for engaging with the strip portions of the cover. Each rib includes a metal structural shape or component (32) and a plurality of saw-tooth components (34) engaged with said structural shape/component and capable of fixing strip portions (18) of the cover thereto.

20 Claims, 4 Drawing Sheets

34
34C
34B
34E
34G 34C
34E
34B 34C
34B
34F
34F
34G 34
34G
34F
36

34
34C
34B
34E
34E
34C
34B
IV
IV
34
34B
34C
34G
34F
36
V
V
VI
VI

SLOTTED UMBRELLA STRUCTURE FOR ATTENUATING THE FORCE OF THE WIND WHEN THE UMBRELLA IS OPEN

There is a known umbrella structure which can attenuate the force of the wind when the umbrella is open, because of the presence of apertures in the fabric of the cover.

According to a prior patent (Italian Patent No. 1,286,846), each of the ribs of the cover consists of an element in the form of a saw tooth, strip portions of the cover being fixed to the trailing edges of these elements, while the leading edges of said saw teeth form slotted apertures in the cover when the umbrella is open.

The present invention relates to an improved design of the supporting ribs of the strip portions of the cover, to achieve greater robustness and lightness of the ribs, more economical manufacture and other objects and advantages which will be made clear by the following text.

According to the present invention, each of said ribs consists of a structural shape—usually made from metal, particularly aluminum or its alloys and a plurality of saw-tooth components engaged with said structural shape and designed to fix thereon the strip portions of the cover.

Advantageously, said structural shape has a channel with a narrow slot; each of said saw-tooth components has appendages which can be housed in said channel by sliding and fixed therein.

In practice, each of said saw-tooth components has a longitudinal appendage along the whole of the side which is to be joined to the structural shape and from which extensions project to complete the area for fixing the cover strips.

There are various suitable methods for fixing the saw-tooth components. In one possible solution, the structural shape is formed with a transverse strip, forming the base of said channel, which is sufficiently thick and has holes for the engagement of screws for fixing said saw-tooth components. In another possible solution, said structural shape is formed to receive nuts which can slide in the channel and are fixed to it with respect to rotation; screws for fixing said saw-tooth components interact with said nuts.

The invention will be more clearly understood from the description and the attached drawing, which shows a practical and non-restrictive example of said invention. In the drawing, FIG. 1 shows a general diagrammatic view of a known umbrella with slots for reducing the force of the wind;

Figure 1:
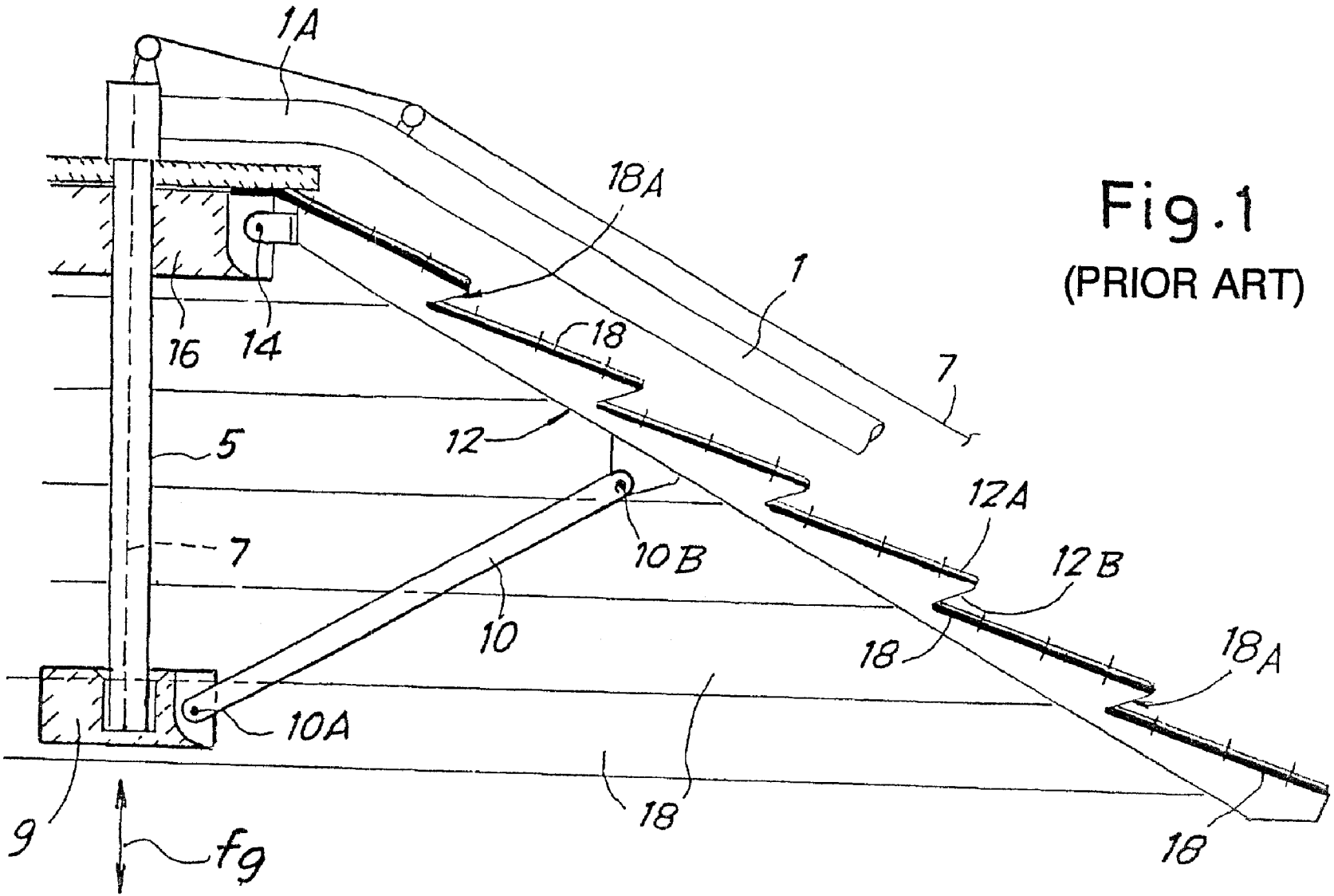
Fig. 1 (PRIOR ART)

In FIG. 1 of the drawing, the number 1 indicates in a general way a supporting arm which extends from a base, in a known arrangement, to support the structure of an openable and closable umbrella suspended on the end 1A. From the end 1A of the supporting arm 1 an element 5 can extend downwards and a cable 7 (or other equivalent component) passing through the element 5 can be used to operate an element 9 which can be raised and lowered as shown by the-double arrow f9 to move the struts 10 for opening and closing the umbrella; one end of each strut is pivoted at 10A on the operating element 9 and the other end is pivoted at 10B on the corresponding rib, indicated in a general way by 12, these ribs being designed to spread out the cover of the umbrella; the ribs 12 are pivoted at 14 on a core 16 which is located at the upper end of the element 5 and which is supported by the arm 1, 1A. The number of ribs 12 is variable; for example, there can be four ribs arranged along the diagonals in a square or rectangular cover, or there can be a greater number, with supplementary ribs in intermediate positions between those indicated by 12, making it possible to provide polygonal covers of various shapes if required. The arm 1 can be orientated in various ways about a vertical axis in the area of the base.

The cover of the umbrella is of the type which presents a smaller surface area to the action of the wind and consequently has greater resistance to the force of the wind even when the umbrella is open, while still providing protection from the sun and rain. For this purpose, the cover is made with a plurality of cover strips 18 which are positioned sequentially in steps, in the form of a roof covering, with slots 18A between one strip 18 and the next; said slots extend in a parallel way to the edges of the cover and concentrically with respect to the assembly 5, 9. These slots allow air to enter and exit; the protection from the sun and rain is obtained by a sufficient degree of overlap between adjacent strips, as seen from above when the umbrella is open.

It must be possible to provide a number of slots which may be relatively large, and the ribs 12 must be designed (according to the known solution) with saw-tooth profiles 12A, 12B; the strips 18 which together form the cover are fixed on the trailing edges 12A of the said saw-tooth profiles; the leading edge 12B of each profile is made in an undercut shape so that the strips 18 partially overlap each other and form the slots 18A between them.

Figure 2:
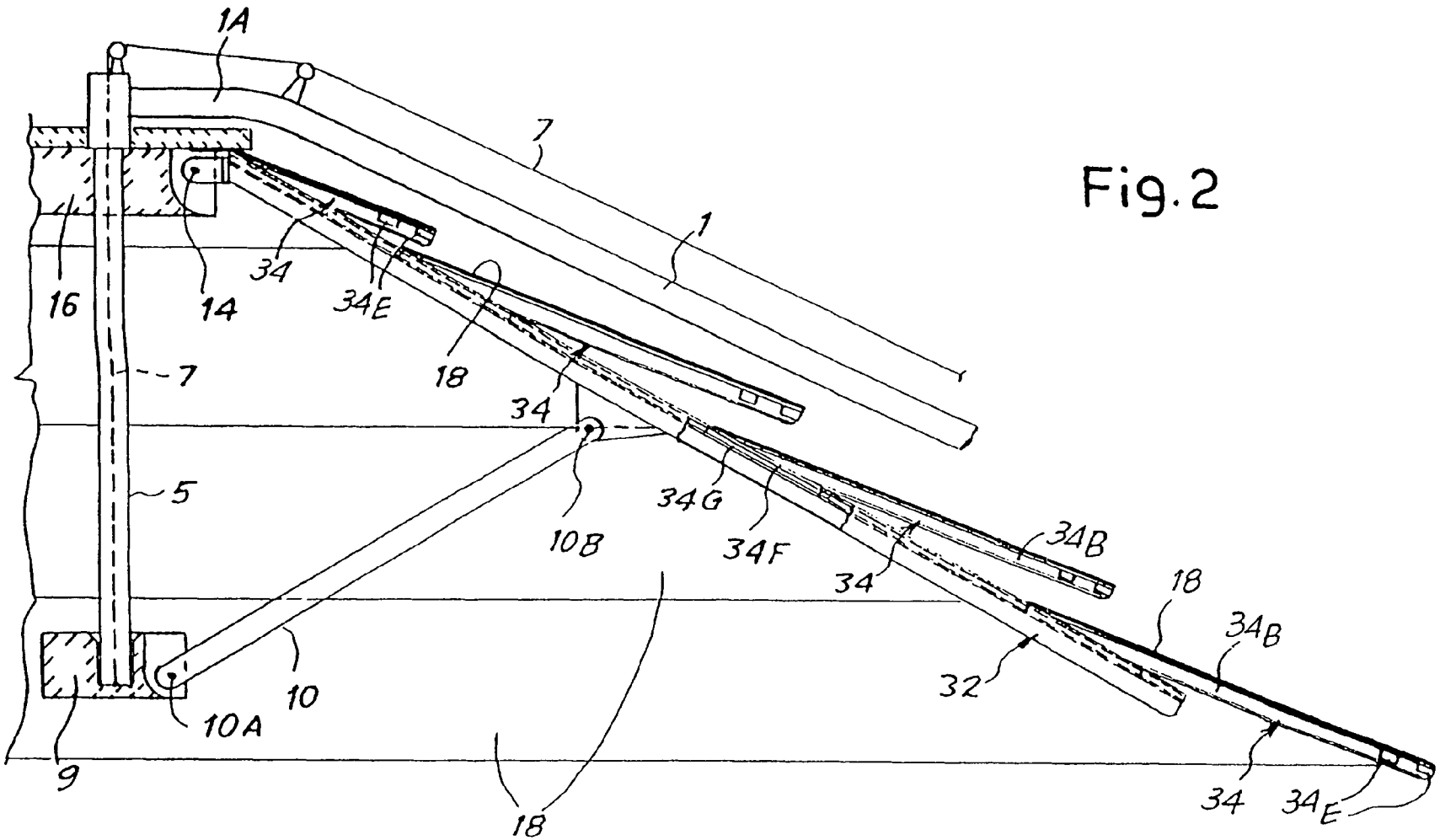
FIG. 2 is a partial general view of an umbrella improved according to the invention.
Figures 3, 3A, 4, 5, 6:
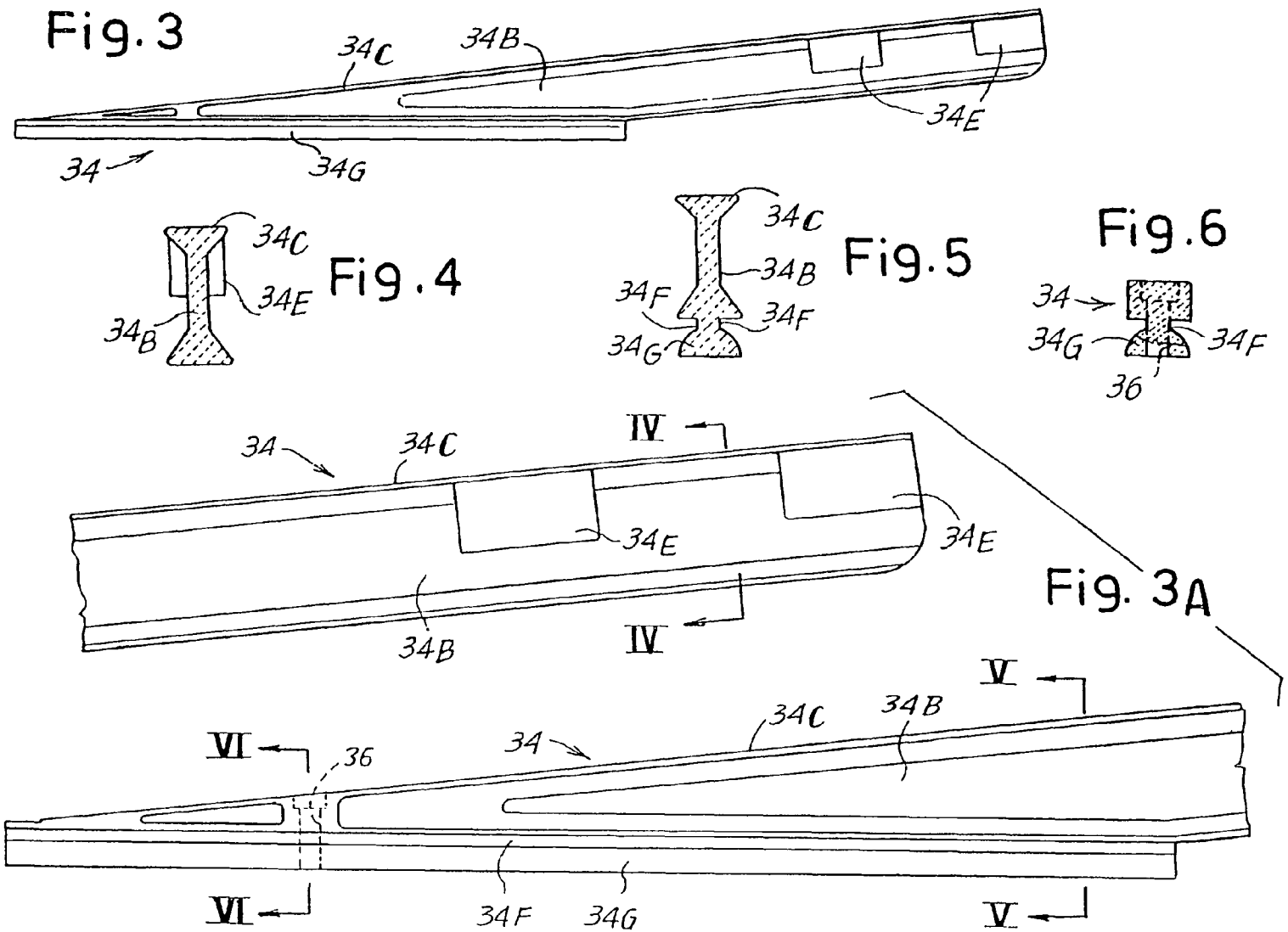
FIGS. 3 and 3A show, in isolation, a saw-tooth component in a general view and in two enlarged details.
FIGS. 4, 5 and 6 are sections taken through IV-IV, V-V and VI-VI of FIG. 3A.
Figure 7:
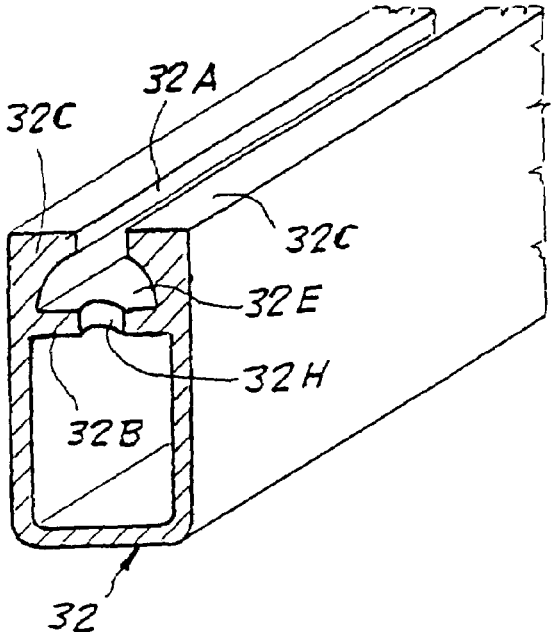
FIG. 7 is a perspective and sectional view of the metal structural shape.

According to the invention, each of the ribs indicated in a general way by 12 is made according to FIG. 2 and the following figures.

The principal element of each rib is a structural shape or component 32, which can be made from aluminum or other material, having as its principal characteristic a longitudinal slot 32A on the upper face and an intermediate partition 32B of suitable thickness; the slot 32A is delimited by edges 32C which face each other; the whole of the structural shape 32 forms a channel 32E.

This structural shape 32 is pivoted at 14 in the way, and for the purposes, described above with reference to FIG. 1.

The saw-tooth structure is made from a plurality of saw-tooth components as indicated in a general way by 34, which can be made from molded synthetic resin with suitable lightening to reduce the weight and cost to a minimum.

In practice, each of these components 34 for the formation of the saw teeth has an insertion base 34A designed for coupling to the structural shape and an extension 34B which forms the trailing edge surface 34C to which the strips 18 are to be coupled and fixed; this extension 34B forms an angle with the base 34A and ultimately enables each component to be extended in such a way that it leaves under the extension 34B an area which can receive a further adjacent component 34, to form the slots equivalent to the slots 18A.

The base 34A can have two lateral channels 34F, which receive the edges 32C forming the slot 32A of the structural shape 32, and an appendage 34G to form an insertion fitting between the structural shape 32 and each of the saw-tooth components 34, this insertion fitting being subsequently secured by screw means which prevent the components 34 from sliding in an uncontrolled way with respect to the structural shape.

The surface 34C is used for fixing the strips 18; said surface 34C has suitable thickened areas 34E underneath it for the screwing in of fixing screws or for the insertion of other elements for fixing the strips 18 to the surface 34C. A thickened area similar to the area 34E, for screws or other means of fixing the fabric, can be provided towards the end of each of the components 34 at which the base 34A and the extension 34B converge. Additional thickened areas similar to the area 34E can be provided in an intermediate position of the upper surface 34C of each of the components 34, for the same purpose of fixing the cover strips. Additionally, holes such as those indicated by 36 are provided in suitable positions for receiving means of fixing the components 34 in the channel 32E, which pass through the slot 32A.

Figure 8:
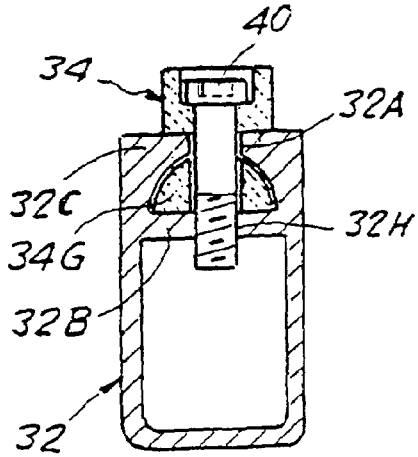
FIG. 8 is a section of the rib assembled, approximately corresponding to the section VI-VI of FIG. 3A.

To lock each of the saw-tooth components 34 so that it cannot slide, it is possible to provide (see FIG. 8) screws 40—particularly self-tapping screws—which pass through the holes 36 and can be screwed into holes 32H in the partition 32B forming the channel 32E of the structural shape 32. These holes 32H can be formed directly by using special screws fitted in the bits of piercing tools.

Figure 9:
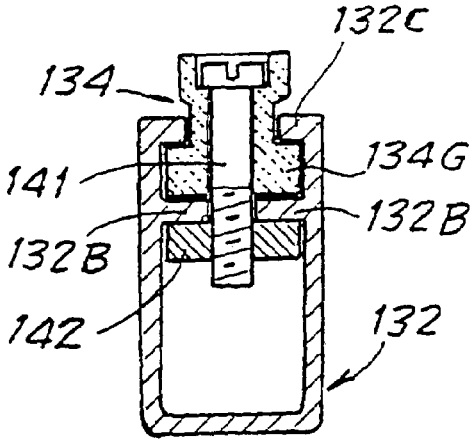
FIGS. 9 and 10 show, in the same way as FIG. 8, two variant embodiments.

In a variant embodiment (see FIG. 9), it is possible to provide screws 141 which can pass through holes 136 (similar to the holes 36) and engage in nuts 142 which can be housed slidably in a structural shape 132 which is similar to the structural shape 32 but which has, in place of the partition 32B, a pair of flanges 132B which oppose the action of the nuts 142, which thus, by means of screws 141, lock the saw-tooth component 134 (similar to the component 34) to the structural shape 132. The channel for slidably housing the base 134G is formed between the edges 132C, similar to the edges 32C, and the edges 132B; the nuts 142 have a prismatic shape so that they engage with the inner walls of the structural shape 132 which is similar to the structural shape 32, but for assembly the nuts 142 can be slid along the structural shape 132 by means of the screws 141 before tightening. The profiles of the components 134 and of the flanges 132C (similar to the flanges 32C) can be designed to prevent an uncontrolled spreading of the two vertical sides of the structural shape 132. A similar arrangement can be made between the edges 132B and the nuts 142, which are prismatic to prevent them from rotating when the screws are tightened.

Figure 10:
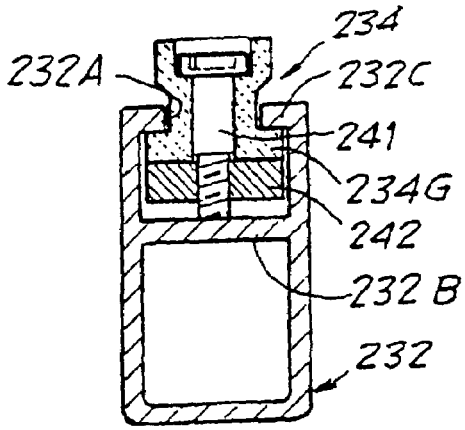

Another variant embodiment is shown in FIG. 10. The structural shape 232 (similar to the structural shape 32) has an unperforated partition 232B; the flanges 232C delimit the slot 232A which is similar to the slot 32A, but the flanges 232C are preferably shaped in the same way as the flanges 132C. In this case, screws 241 are screwed into nuts 242 which are held between the partition 232B and the flanges 232C and can be slid in the structural shape 232 by the screws 241 but are fixed with respect to rotation by bearing on the inner walls of the structural shape 232. When the screw 241 is screwed into the nut 242, the screw bears on the partition 232B and the nut 242 is forced on to the base 234G, thus forcing the latter against the flanges 232C.

It is to be understood that the drawing shows only an example provided solely as a practical demonstration of the invention, and that this invention can be varied in its forms and arrangements without departure from the guiding principle of the invention; the presence of reference numbers in the attached claims is intended to facilitate the reading of the claims with reference to the description and to the drawing, and does not limit the scope of protection represented by the claims.

The invention claimed is:

1. Umbrella structure with ribs having a saw-tooth profile on the trailing edges of which are fixed strip portions of the cover, characterized in that each of said ribs include a structural shape and a plurality of saw-tooth components engaged with said structural shape and capable of fixing the strip portions of the cover to each said rib;

each said structural shape has a channel with a slot;

each saw-tooth component has an insertion base whose profile is such that it can enter and slide in said channel and can be fixed there, and an extension at an angle to the insertion base, to form the surface for fixing the cover strips.

2. Structure according to claim 1, wherein: said structural shape has a narrow slot, and in that each of said saw-tooth components has appendages which can be received in said channel by sliding and fixed therein.

3. Structure according to claim 2, characterized in that each of said saw-tooth components has a base with a longitudinal appendage extending along a whole length of the base for coupling to the structural shape.

4. Structure according to claim 3, characterized in that said structural shape is formed with a strip or transverse partition—forming a base of said channel—which is sufficiently thick for engagement of screws for fixing said saw-tooth components.

5. Structure according to claim 3, characterized in that said structural shape is shaped to receive nuts which can slide in the structural shape, said nuts being fixed to the structural shape with respect to rotation, enabling said saw-tooth components to be fixed by means of screws.

6. Structure according to claim 2, characterized in that each of said plurality of sawtooth components defines a screw hole and a screw rotatably arranged in said screw hole; said structural shape is formed with a transverse partition—forming a base of said channel—which is sufficiently thick for engagement of said screw for fixing said saw-tooth components, said transverse partition being arranged at said channel diametrically opposite to said slot.

7. A structure according to claim 6, wherein:

said transverse partition defines a hole receiving said screw of said sawtooth component.

8. A structure according to claim 7, wherein:

said screw is directly fastened to said transverse partition.

9. A structure according to claim 7, wherein:

said structural shape defines another channel on a side of said transverse partition diametrically opposite from said channel;

said each sawtooth component includes a nut shaped to slide in said another channel and be fixed in said another channel with respect to rotation, said screw engaging with said nut to fasten said nut and a respective said appendage to said transverse partition.

10. Structure according to claim 2, characterized in that said structural shape is shaped to receive nuts which can slide in the structural shape, said nuts being fixed to the structural shape with respect to rotation, enabling said saw-tooth components to be fixed by means of screws.

11. Structure according to claim 1, characterized in that each of said plurality of sawtooth components defines a screw hole and a screw rotatably arranged in said screw hole; said structural shape is formed with a transverse partition—forming a base of said channel—which is sufficiently thick for engagement of said screw for fixing said saw-tooth components, said transverse partition being arranged at said channel diametrically opposite to said slot.

12. Structure according to claim 1, characterized in that said structural shape is shaped to receive nuts which can slide in the structural shape, said nuts being fixed to the structural shape with respect to rotation, enabling said saw-tooth components to be fixed by means of screws.

13. An umbrella comprising:

a plurality of ribs, each of said ribs including a structural component and a plurality of sawtooth components fixedly connected to each said structural component, each said structural component defining a longitudinal channel inside a respective said structural component, said each structural component also defining a longitudinal slot in communication with said channel and in communication with an outside of said respective structural component, each said plurality of sawtooth components including an appendage, said appendage, said slot and said channel being shaped to have said appendage slide through said slot and said channel, said appendage of each sawtooth component being fixed in a respective said channel of a respective structural component, said sawtooth components of each said rib being spaced longitudinally apart along said channel;

a plurality of cover strips, each of said cover strips being mounted on one of said plurality of sawtooth components of each of said plurality of ribs.

14. An umbrella according to claim 13, wherein:

each said saw-tooth component includes an insertion base with a profile that can enter and slide in said channel and can be fixed there, said each sawtooth component also including an extension at an angle to said insertion base, to form a surface for fixing said cover strips.

15. An umbrella according to claim 13, wherein:

each of said plurality of sawtooth components defines a screw hole and a screw rotatably arranged in said screw hole;

said structural component is formed with a transverse partition forming a base of said channel, said transverse partition having a thickness for engagement of said screw for fixing said saw-tooth components, said transverse partition being arranged at said channel diametrically opposite to said slot.

16. An umbrella according to claim 15, wherein:

said transverse partition defines a hole receiving said screw of said sawtooth component.

17. An umbrella according to claim 16, wherein:

said screw is directly fastened to said transverse partition.

18. An umbrella according to claim 16, wherein:

said structural component defines another channel on a side of said transverse partition diametrically opposite from said channel;

said each sawtooth component includes a nut shaped to slide in said another channel and be fixed in said another channel with respect to rotation, said screw engaging with said nut to fasten said nut and said appendage to said transverse partition.

19. An umbrella according to claim 15, wherein:

said each sawtooth component includes a nut shaped to slide in said channel and be fixed in said channel with respect to rotation, said screw engaging with said nut to press said screw against said transverse partition.

20. An umbrella according to claim 13, wherein:

said structural component is shaped to receive nuts which can slide in said channel and are fixed in said channel with respect to rotation, said nuts enabling said saw-tooth components to be fixed by screws.

* * * * *